US008123222B2

(12) United States Patent
Ong

(10) Patent No.: US 8,123,222 B2
(45) Date of Patent: Feb. 28, 2012

(54) COMPLIANT CONVEYANCE SYSTEM FOR MAILPIECE TRANSPORT ALONG AN ARCUATE FEED PATH

(75) Inventor: Henson C. Ong, Waterbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/433,962

(22) Filed: May 1, 2009

(65) Prior Publication Data

US 2010/0280652 A1 Nov. 4, 2010

(51) Int. Cl.
*B65H 5/04* (2006.01)
*B65H 39/10* (2006.01)

(52) U.S. Cl. ..... 271/276; 271/297; 271/284; 271/305; 271/194

(58) Field of Classification Search ..... 271/184, 271/186, 196, 194, 195, 276, 189, 178, 303, 271/305, 284, 309
See application file for complete search history.

(56) References Cited

U.S. PATENT DOCUMENTS

| | | | | | |
|---|---|---|---|---|---|
| 3,598,401 | A | * | 8/1971 | Snellman | 271/224 |
| 3,845,951 | A | * | 11/1974 | Hamaker | 271/243 |
| 4,056,264 | A | * | 11/1977 | Dhooge et al. | 271/177 |
| 4,087,177 | A | * | 5/1978 | Gumm et al. | 355/47 |
| 4,207,998 | A | * | 6/1980 | Schmid | 226/95 |
| 4,440,388 | A | * | 4/1984 | Divoux et al. | 271/195 |
| 4,466,605 | A | * | 8/1984 | Leuthold et al. | 271/177 |
| 5,135,115 | A | * | 8/1992 | Miller et al. | 209/564 |
| 5,203,556 | A | * | 4/1993 | Smith et al. | 271/308 |
| 5,427,368 | A | * | 6/1995 | Abe et al. | 271/283 |
| 5,913,268 | A | * | 6/1999 | Jackson et al. | 101/420 |
| 7,670,100 | B2 | * | 3/2010 | Hannen et al. | 414/789.1 |
| 7,770,889 | B2 | * | 8/2010 | Ong et al. | 271/284 |

FOREIGN PATENT DOCUMENTS

| | | | | |
|---|---|---|---|---|
| JP | 60223747 | A | * | 11/1985 |
| JP | 01081731 | A | * | 3/1989 |

* cited by examiner

*Primary Examiner* — Michael McCullough
*Assistant Examiner* — Luis A Gonzalez
(74) *Attorney, Agent, or Firm* — Brian A. Collins; Charles R. Malandra, Jr.; Steven J. Shapiro

(57) ABSTRACT

A compliant conveyance system including a diverter having at least one sidewall structure defining an internal chamber in fluid communication with a pressure source. The sidewall structure includes a compliant interface surface for conveying sheet material along the feed path and a plurality of orifices effecting fluid communication between the compliant interface surface and the internal chamber. A means is provided for developing a pressure differential across the sheet material through the orifices to urge an interface surface of the sheet material against the compliant interface surface of the diverter such that the compliant interface surface conforms to the sheet material interface surface. The system employs a means for driving the diverter about a rotational axis from a first to a second rotational position and a controller for controlling the pressure differential such that, in the first rotation position, the sheet material is secured against the compliant interface surface and, in the second rotational position, the sheet material is released therefrom.

9 Claims, 8 Drawing Sheets

FIG. 3
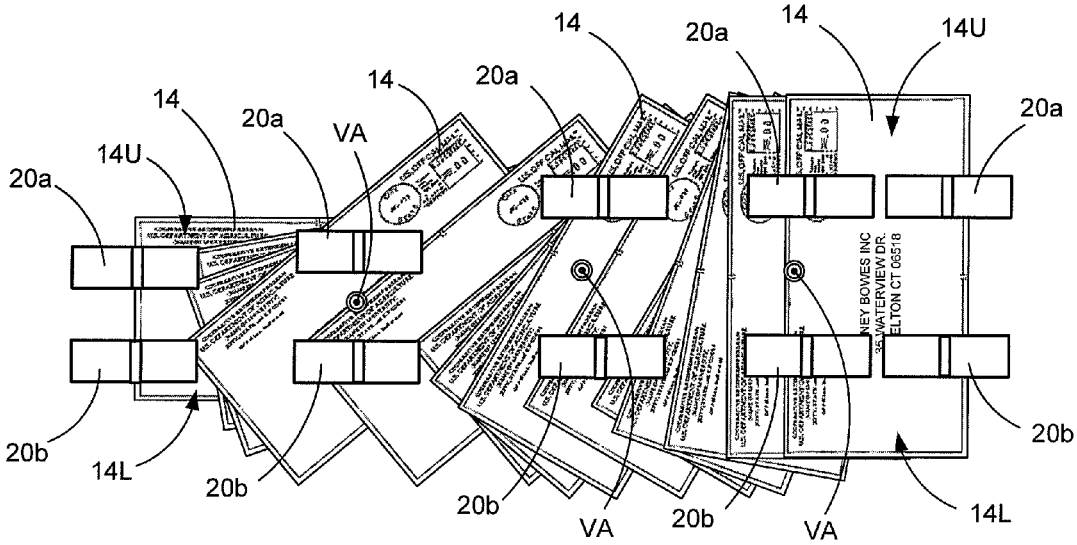
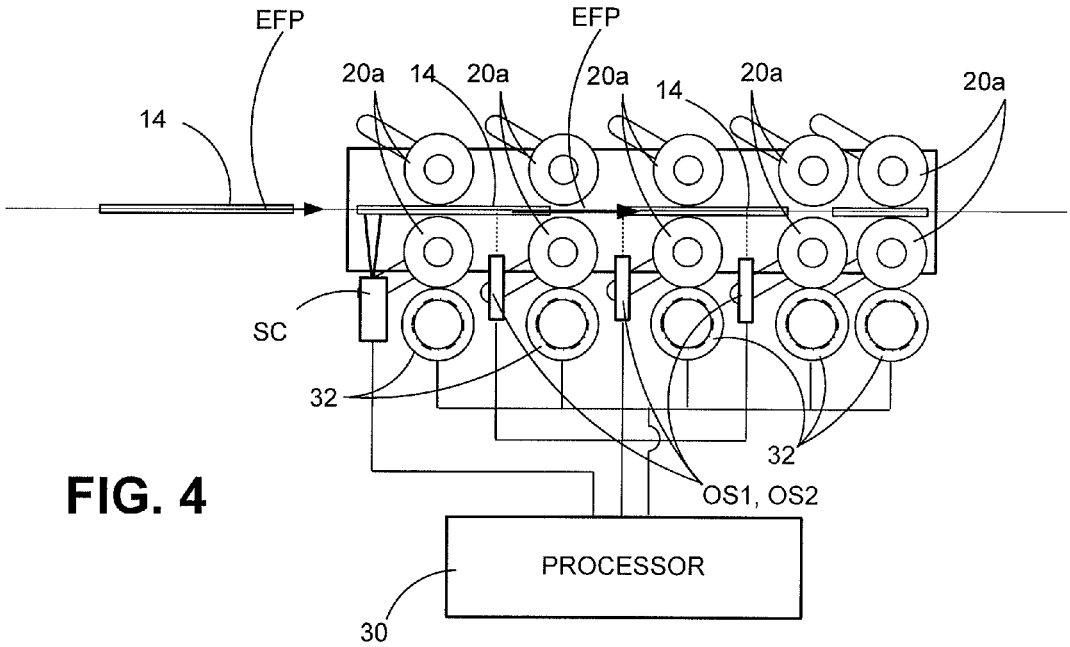
FIG. 4

COMPLIANT CONVEYANCE SYSTEM FOR MAILPIECE TRANSPORT ALONG AN ARCUATE FEED PATH

TECHNICAL FIELD

This invention relates to an apparatus for handling sheet material and more particularly to a pneumatic conveyance system which facilitates the handling of stiff planar sheets along an arcuate, e.g., circular feed path.

BACKGROUND ART

Automated equipment is typically employed in industry to process, print and sort sheet material for use in manufacture, fabrication and mailstream operations. One such device to which the present invention is directed is a mailpiece sorter which sorts mail into various bins or trays for delivery.

Mailpiece sorters are often employed by service providers, including delivery agents, e.g., the United States Postal Service USPS, entities which specialize in mailpiece fabrication, and/or companies providing sortation services in accordance with the Mailpiece Manifest System (MMS). Regarding the latter, most postal authorities offer large discounts to mailers willing to organize/group mail into batches or trays having a common destination. Typically, discounts are available for batches/trays containing a minimum of two hundred (200) or so mailpieces.

The sorting equipment organizes large quantities of mail destined for delivery to a multiplicity of destinations, e.g., countries, regions, states, towns and/or postal codes, into smaller, more manageable, trays or bins of mail for delivery to a common destination. For example, one sorting process may organize mail into bins corresponding to various regions of the U.S., e.g., northeast, southeast, mid-west, southwest and northwest regions, i.e., outbound mail. Subsequently, mail destined for each region may be sorted into bins corresponding to the various states of a particular region e.g., bins corresponding to New York, New Jersey, Pennsylvania, Connecticut, Massachusetts, Rhode Island, Vermont, New Hampshire and Maine, sometimes referred to as inbound mail. Yet another sort may organize the mail destined for a particular state into the various postal codes within the respective state, i.e., a sort to route or delivery sequence.

The efficacy and speed of a mailpiece sorter is generally a function of the number of sortation sequences or passes required to be performed. Further, the number of passes will generally depend upon the diversity/quantity of mail to be sorted and the number of sortation bins available. At one end of the spectrum, a mailpiece sorter having four thousand (4,000) sorting bins or trays can sort a batch of mail having four thousand possible destinations, e.g., postal codes, in a single pass. Of course, a mailpiece sorter of this size is purely theoretical, inasmuch as such a large number of sortation bins is not practical in view of the total space required to house such a sorter. At the other end of the spectrum, a mailpiece sorter having as few as eight (8) sortation bins (i.e., using a RADIX sorting algorithm), may require as many as five (5) passes though the sortation equipment to sort the same batch of mail i.e., mail to be delivered to four thousand (4,000) potential postal codes. The number of required passes through the sorter may be evaluated by solving for P in equation (1.0) below:

$$P^{(\#\ of\ Bins)} = \#\ \text{of Destinations} \tag{1.0}$$

In view of the foregoing, a service provider typically weighs the technical and business options in connection with the purchase and/or operation of the mailpiece sortation equipment. On one hand, a service provider may opt to employ a large mailpiece sorter, e.g., a sorter having one hundred (100) or more bins, to minimize the number of passes required by the sortation equipment. On the other hand, a service provider may opt to employ a substantially smaller mailpiece sorter e.g., a sorter having sixteen (16) or fewer bins, knowing that multiple passes and, consequently, additional time/labor will be required to sort the mail.

The principal technical/business issues include, inter alia: (i) the number/type of mailpieces to be sorted, (ii) the value of discounts potentially available through sortation, (iii) the return on investment associated with the various mailpiece sortation equipment available and (iv) the cost and availability of labor. FIG. 1 depicts a conventional linear mailpiece sorter 100 having a plurality of sortation bins or collection trays 110 disposed on each side of a linear sorting path SP. In operation, the mailpieces 114 are first stacked on-edge in a feeder module 116 and fed toward a singulation belt 120 by vertical separator plates 122. The plates 122 are driven along, and by means of, a feed belt 124 which urges the mailpieces 114 against the singulation belt 120. As a mailpiece 114 engages the singulation belt 120, the mailpiece 114 is separated from the stack and conveyed along the sorting path SP. Inasmuch as the singulation belt 120 and sorting path SP are disposed orthogonally of the feed path FP, each mailpiece 114 may be conveyed directly along the sorting path SP without any further requirements to manipulate the direction and/or orientation of the mailpiece 114, e.g., a right-angle turn.

As each mailpiece 114 is conveyed along the sorting path SP, a mailpiece scanner 126 typically reads certain information i.e., identification, destination, postal code information, etc., contained on the face of the mailpiece 114 for input to a processor 130. Inasmuch as each of the sortation bins or trays 110 correspond to a pre-assigned location in the RADIX sortation algorithm, the processor 130 controls a plurality of diverter mechanisms 134 (i.e., one per bin/tray 110) to move into the sorting path SP at the appropriate moment time to collect mailpieces 114 into the trays 110. That is, since the mailpiece sorter 110 knows the identity and location of each mailpiece 114 along the sorting path SP, the processor 130 issues signals to rapidly activate the diverter mechanisms 134 so as to re-direct a particular mailpiece 114 into its pre-assigned collection tray 110. A linear mailpiece sorter of the type described above is manufactured and distributed by Pitney Bowes Inc. located in Stamford, State of Connecticut, USA, under the tradename "Olympus II".

As mentioned in a preceding paragraph, the total space available to a service provider/operator may prohibit/preclude the use of a large linear mailpiece sorter such as the type described above. That is, since each collection tray 110 must accommodate a conventional type-ten (No. 10) mailpiece envelope, each tray 110 spans a distance slightly larger than one foot (1') or about fourteen inches (14"), corresponding to the long edge of the rectangular mailpiece 114. As a result, a linear mailpiece sorter can occupy a large area or "footprint", i.e., requiring hundreds of lineal feet and/or a facility competing with the size of a conventional aircraft hanger.

In an effort to accommodate service providers with less available space/real estate, other mailpiece sortation devices are available which employ a multi-tiered bank of collection trays (i.e., arranged vertically). These sortation devices (not shown) include an intermediate elevation module disposed between the feeder and bank of collection trays. More specifically, the elevation module includes a highly inclined table or deck for supporting a labyrinth of twisted conveyor belt pairs. The belt pairs capture mailpieces therebetween and convey mailpieces along various feed paths which are formed by a series of "Y"-shaped branches. Each Y-shaped branch/intersection bifurcates or diverts mailpieces to one of two downstream paths, and additional branches downstream of each new path increase the number of paths by a factor of two. Further, each branch functions to change the elevation of a mailpiece to feed the multi-tiered arrangement of collection trays. A multi-tiered mailpiece sorter of the type described above is manufactured and distributed by Pitney Bowes Inc. located in Stamford, State of Connecticut, USA, under the tradename "Olympus II".

Multi-tiered mailpiece sorters can significantly reduce the space/footprint required by linear mailpiece sorters, though such multi-tiered sorters are costly to fabricate, operate and maintain. Typically, these multi-tiered mailpiece sorters are nearly twice as costly to fabricate and maintain as compared to linear mailpiece sorters having the same or greater sorting capacity.

In addition to the difficulties associated with space and expense, the mailpiece sorters described above are highly complex, require highly-skilled technicians to perform maintenance and, if not maintained properly, can result in damage to sorted mailpieces. For example, if particulate matter (e.g., paper dust) from envelopes is allowed to accumulate along the sorting path and/or in the actuation mechanisms of a diverter, the mailpiece sorter can become prone to paper jams. Further, inasmuch as the mailpieces travel at a high rate of speed along the sorting path SP, the mailpieces can be damaged or jammed when re-directed by the by the diverter mechanism. Moreover, in addition to damage caused by jamming, the sortation order of the mailpieces, which is critical to perform a RADIX sort, can inadvertently be altered.

Yet other difficulties relate to the handling of relatively stiff, planar, material/packages such as a plastic container for holding/housing computer discs, e.g., CDs and DVDs. Due to the rigidity of these packages difficulties arise when transporting such material around a bend or arcuate feed path. That is, when transporting such packages between opposing belts, damage to the plastic container can occur when negotiating a bend, especially when the bend radius thereof is small.

A need, therefore, exists for a sheet material handling apparatus of minimal size for space efficiency, provides a smooth conveyance/diversion path for preventing paper jams along the feed path, and facilitates the handling of relatively stiff, planar material packages to prevent damage as the package travels along an arcuate feed path.

BRIEF DESCRIPTION OF THE DRAWINGS

The accompanying drawings illustrate presently preferred embodiments of the invention and, together with the detailed description given below, serve to explain the principles of the invention. As shown throughout the drawings, like reference numerals designate like or corresponding parts.

FIG. 3 depicts a side schematic view of the displacement module/system including a plurality of cooperating rollers, i.e., pairs of rollers, which are differentially controlled to displace and rotate the mailpiece from an on-edge lengthwise orientation to an on-edge widthwise orientation.

FIG. 4 depicts an enlarged top view of the displacement module including a processor for controlling a plurality of rotary actuators or motors to drive the cooperating rollers.

SUMMARY OF THE INVENTION

Figure 1:
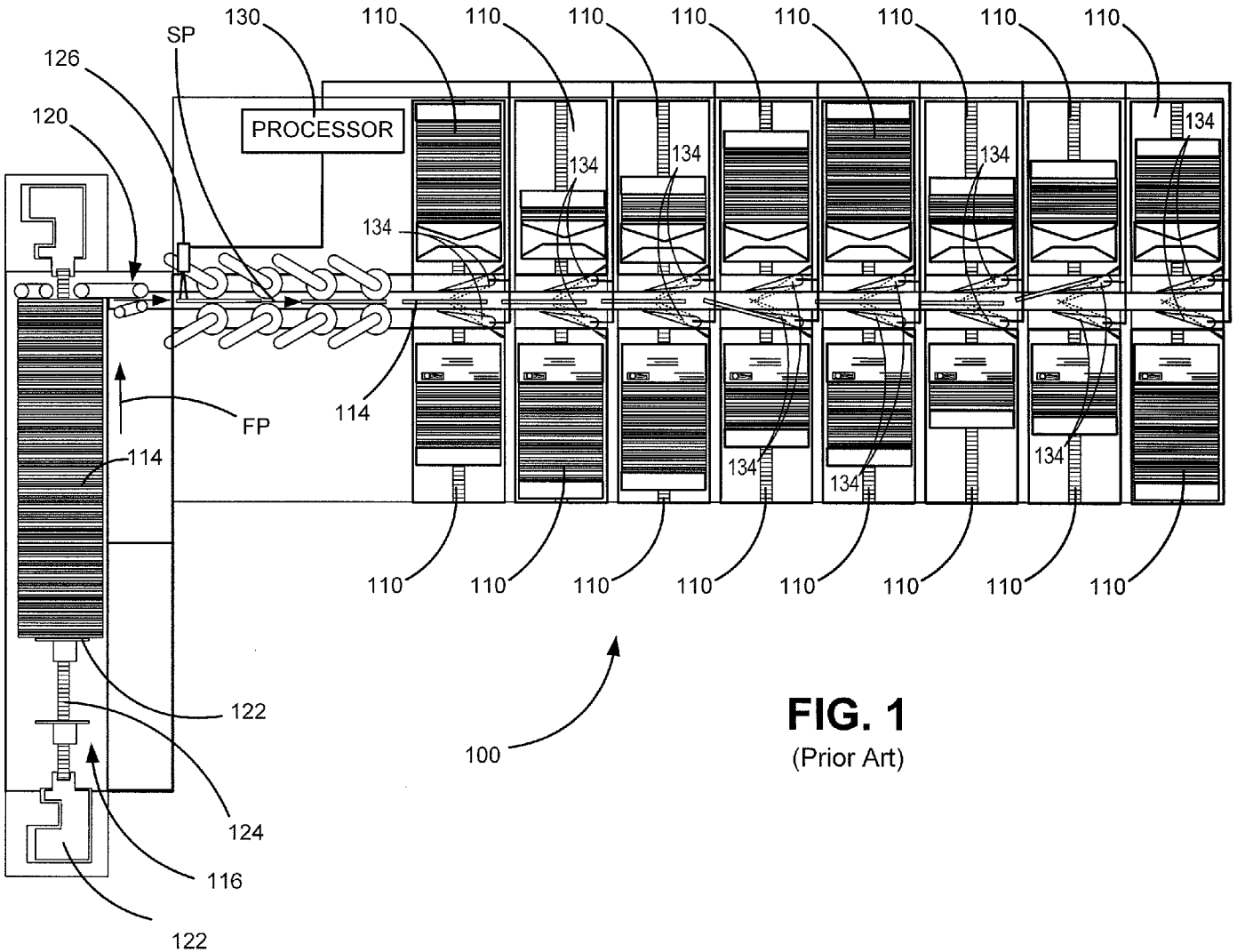
FIG. 1 (Prior Art)
FIG. 1 is a top view of a prior art mailpiece sorter including a plurality of sorting bins disposed on each side of a mailpiece sorting path.

A compliant conveyance system is provided for conveying and diverting sheet material along a feed path. The system includes a diverter having at least one sidewall structure defining an internal chamber in fluid communication with a pressure source. The sidewall structure includes a compliant interface surface for conveying sheet material along the feed path and a plurality of orifices facilitating fluid communication between the compliant interface surface and the internal chamber. The system further includes a means for developing a pressure differential across the sheet material through the orifices to urge an interface surface of the sheet material against the compliant interface surface of the diverter such that the compliant interface surface conforms to at least a portion of the sheet material interface surface. The system employs a means for driving the diverter about a rotational axis from a first to a second rotational position and a controller operative to control the pressure differential such that, in the first rotation position, the sheet material is secured against the compliant interface surface and, in the second rotational position, the sheet material is released from the compliant interface surface.

DETAILED DESCRIPTION

A sortation system is described for handling sheet material in a mailpiece sorter. While the invention is described in the context of a mailpiece sorter, it will be appreciated that the various inventive features are equally applicable to any sheet material handling apparatus. Hence the sorting system is merely illustrative of an embodiment of the invention and other embodiments are contemplated.

The sortation apparatus includes a displacement module which transposes sheet material from a first on-edge orientation/position to a second on-edge orientation/position, substantially ninety-degrees (90° from the angular position of the first position. The angular displacement or transposition allows sheet material to be stacked within trays of a sheet material sorter which, in combination, reduce the overall length requirements of the sorter and, consequently, the space requirements thereof.

In the context used herein, "sheet material" means any sheet, page, document, or media wherein the dimensions in a third dimension are but a small fraction, e.g., 1/100th of the dimensions and stiffness characteristics in the other two dimensions. As such, the sheet material is substantially "flat" or planar. In addition to individual sheets of paper, plastic or fabric, objects such as envelopes and folders may also be considered "sheet material" within the meaning herein. Furthermore, mailpieces having relatively slender/thin/stiff objects contained within an envelope also are embraced within the definition of sheet material.

The invention described and illustrated herein discloses various features of a sheet material handling apparatus including: (i) a displacement system/module for transposing sheet material from a first to a second on-edge orientation (ii) a pneumatic conveyance/diverting system for delivering sheet material conveyed along a central feed path and diverting the sheet material to sortation bins on either side of the feed path, and (iii) a compliant conveyance system for transporting relatively stiff, planar mailpieces along an arcuate or "curved" feed path.

Figure 2:
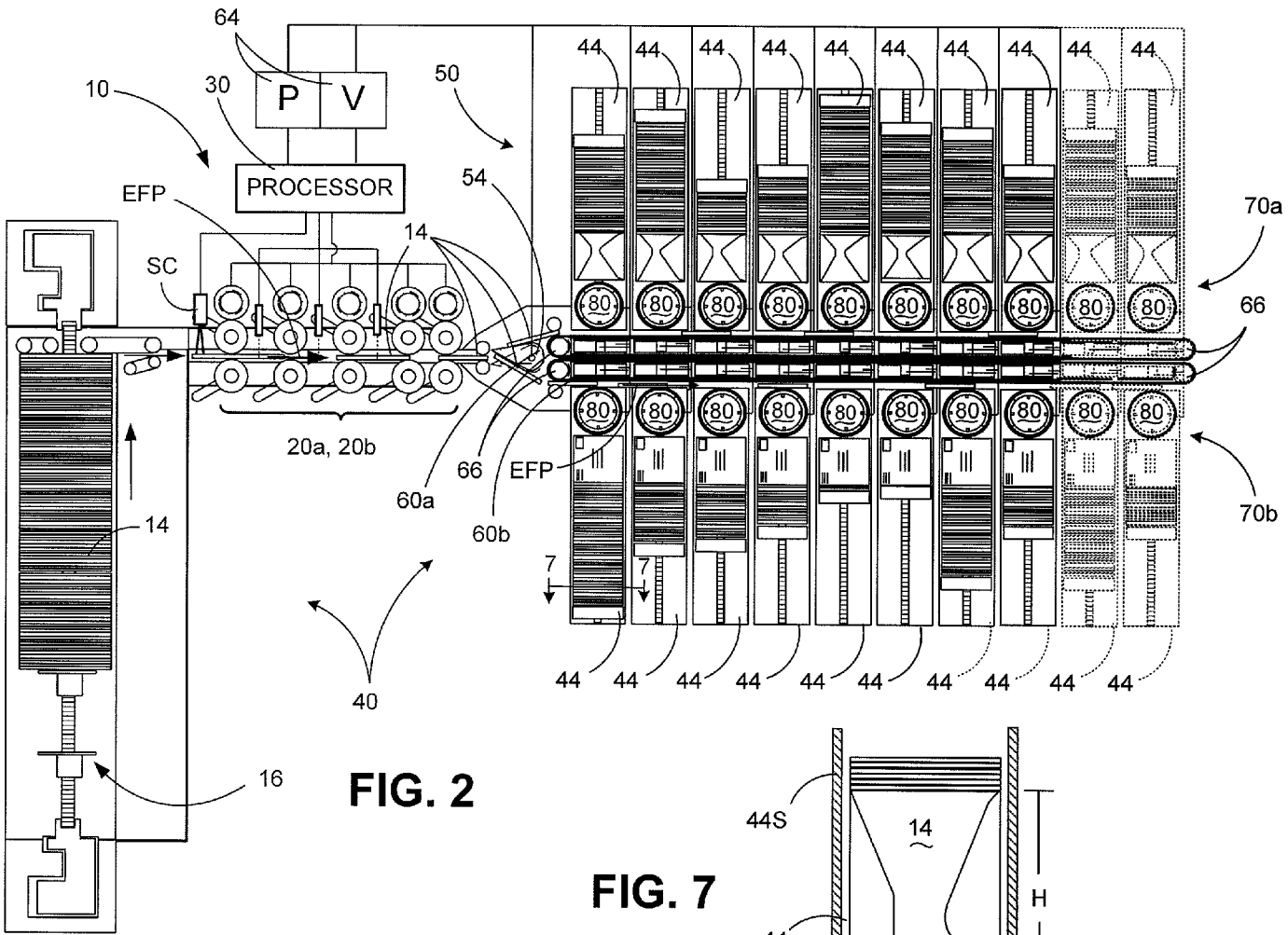
FIG. 2 is a partially broken away and sectioned top view of a mailpiece sorter including: a feeder, a displacement module/system operative to transpose the orientation of each mailpiece, and a sortation bin module operative to convey and divert mailpieces.

FIGS. 2, 3, and 4 illustrate a displacement module 10 that includes a series of cooperating elements 12 which act on a mailpiece 14 to transpose its orientation from a first on-edge orientation to a second on-edge orientation. In the context used herein, the mailpiece 14 is generally rectangular in shape such that one side is necessarily longer or shorter than an adjacent side. For example, a typical type-ten (No. 10) mailpiece envelope has a length dimension of about eleven and one-half inches (11.5") and a width dimension of about four and one-half inches (4.5").

Displacement Module for Transposing Sheet Material

The mailpiece 14 is fed and singulated in a conventional manner by a sheet feeding apparatus 16. The sheet feeding apparatus 16 feeds each mailpiece 14 in an on-edge lengthwise orientation towards the displacement module 10 which accepts the mailpiece 14 between or within coupled pairs of cooperating elements such as rollers 20*a*, 20*b*. Prior to being accepted within the displacement module 10, a scanner SC typically reads the mailpiece 14 and communicates the information to a processor 30 (FIGS. 2 and 4) for the purposes of performing a sortation algorithm. This sortation algorithm is subsequently used to control the various diverter mechanisms 26 (FIG. 2) within the sortation bin module 50.

Furthermore, the scanner SC may process the data obtained to "verify" the mailing address prior to sortation. More specifically, it is often desirable to check the veracity of a mailing address prior to sorting to ensure that the mailing address is correct and current. This is accomplished by producing an Optical Character Recognition (OCR) image of the address and communicating with a central database to compare the OCR data with "validated address" data the determine whether the address is accurate and up-to-date, e.g., to check whether the recipient has moved to a new address. Once scanned and validated, it is also common to print a barcode representation of the mailing address, at a print station (not shown) downstream of the scanner SC and upstream of the displacement module 10, to facilitate subsequent delivery of each mailpiece 14. Valid mailpieces may then be sorted while invalid mailpieces may be outsorted for further processing, e.g., returned to sender.

Each coupled pair comprises a first pair of rollers 20*a* defining an upper nip 22*a* (see FIGS. 3 and 4) which accepts an upper portion 14U of the mailpiece 14 and a second pair of rollers 20*b* defining a lower nip 22*b* which accepts a lower portion 14L of the mailpiece 14. In the context used herein, a "nip" means any pair of opposing surfaces, or cooperating elements, which secure and hold an article, or portion of an article, therebetween. Consequently, a nip can be defined as being between rolling elements, spherical surfaces, flat bands or compliant belts.

As the mailpiece 14 traverses the displacement module 10, the coupled pairs 20*a*, 20*b* cooperate to linearly displace and rotate the mailpiece 14 along the envelope feed path EFP. As best seen in FIG. 3, five (5) pairs of upper rollers 20*a* and five (5) pairs of lower rollers 20*b* move the mailpiece 14 linearly along the sheet path SP. Simultaneously, or as the mailpiece moves from left to right in FIG. 3, several of the coupled pairs 20*a*, 20*b* rotate the mailpiece 14 about virtual axes VA to transpose its orientation from an on-edge lengthwise orientation to an on-edge widthwise orientation. To effect rotation, the displacement module 10 includes a means to differentially drive the coupled pairs 20*a*, 20*b* such that the lower portion 14L of the mailpiece 14 incrementally travels at a different, e.g., a higher, speed or velocity. In the described embodiment, as each mailpiece 14 fed through the displacement module 10 reaches various threshold positions between the coupled pairs 20*a*, 20*b*, each of the lower pairs 20*b* may be driven at a higher rotational speed relative to the respective upper pair 20*a*.

More specifically, the processor 30 (see FIG. 4) is operative to control a plurality of rotary actuators or motors 32 which drive the upper and lower pairs 20*a*, 20*b* of rollers. The motors 32 may drive only one of the rollers in each of the pairs 20*a*, 20*b*, while the other roller serves as an idler to define the upper and lower nips 22*a*, 22*b*. As a mailpiece 14 moves along the feed path EFP and between the coupled pairs 20*a*, 20*b*, the motors 32 may be driven at the same or differential speeds to effect linear or rotational motion. For example, the motors 32 may be driven in unison such that both upper and lower portions 14U, 14L of the mailpiece 14 are displaced at the same speed. Under such control, the mailpiece 14 moves linearly from one coupled pair 20*a*, 20*b* to another pair 20*a*, and 20*b*. When the mailpiece 14 reaches a threshold position between a coupled pair 20*a*, 20*b*, the motors 32 may be differentially driven such that the upper and lower portions 14U, 14L of the mailpiece 14 are differentially displaced, e.g., the lower portion 14L moves at a higher speed than the respective upper portion 14U. Under this control, the mailpiece 14 rotates about the virtual axis VA such that the mailpiece 14 changes orientation, e.g., is rotationally displaced.

Figure 5:
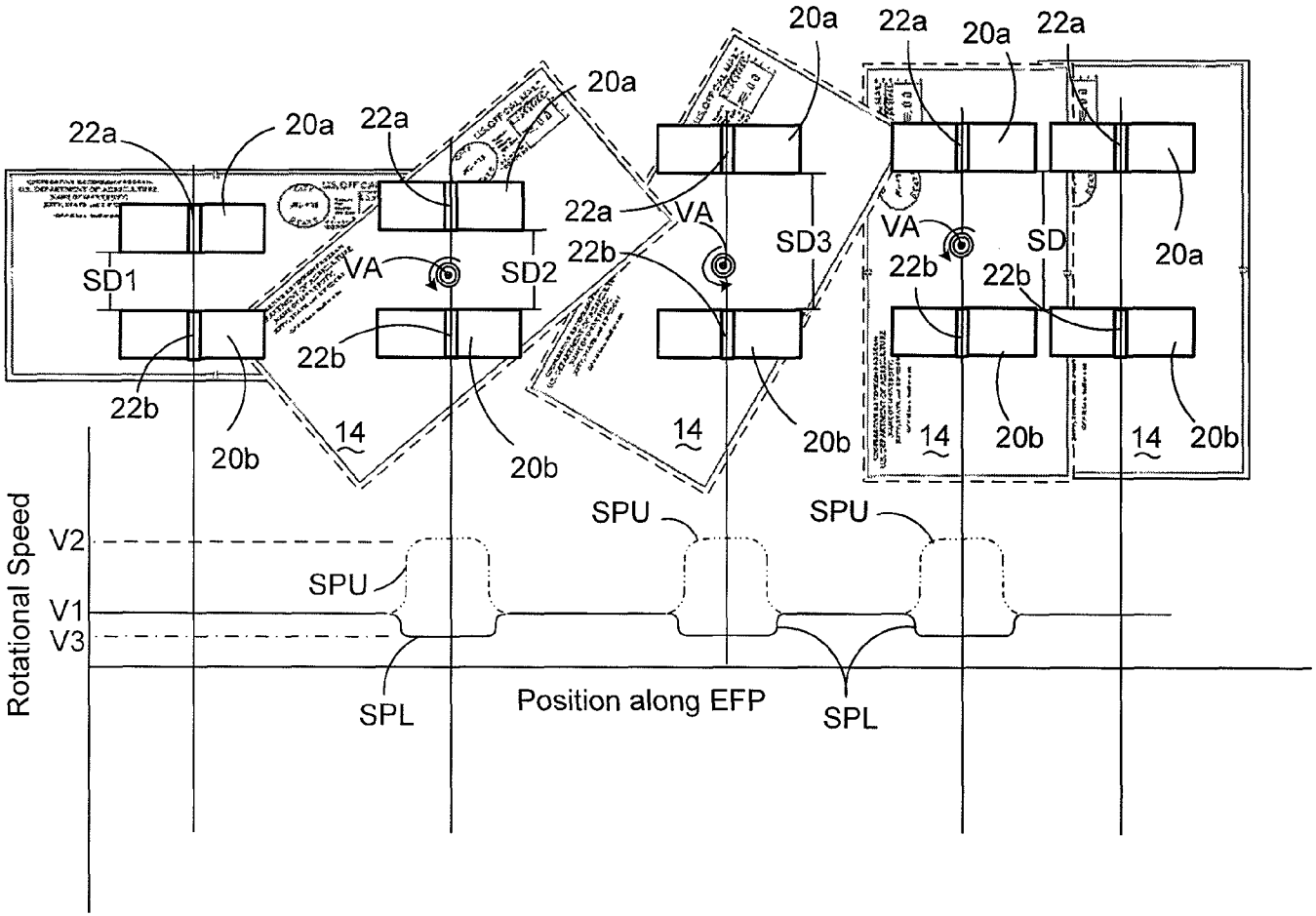
FIG. 5 depicts the speed profile of the rollers wherein the motors are controlled to alternately linearly displace and rotationally position each mailpiece along the feed path.

In FIG. 5, a dimensionless speed profile of the coupled pairs 20*a*, 20*b* is depicted to demonstrate the method of motor control. Therein, the rotational velocity of the driven rollers 20*a*, 20*b* are plotted relative to the mean position of the mailpiece 14 along the envelope feed path EFP. Upon reaching the nips 22*a*, 22*b* of the upper and lower pairs 20*a*, 20*b*, the speed V1 of both pairs 20*a*, 20*b* is equal or matched such that the mailpiece 14 translates linearly without rotation. That is, each of the upper and lower portions 14U, 14L of the mailpiece is displaced at the same rate of speed. Upon reaching a threshold position between the upper and lower nips 22*a*, 22*b* of a subsequent or downstream pair of rollers 20*a*, 20*b*, the processor 30 drives the motors 32 to increase the rotational speed of the lower pair 20*b* to a second speed V2 while decreasing the rotational speed of the upper pair 20*a* to a third speed V3. The solid line SPL denotes the speed profile of the upper rollers 20*a*, while the dashed line SPU represents the speed profile of the lower pair of rollers 20*b*. This speed differential effects rotation of the mailpiece 14 as the mailpiece 14 continues to move downstream along the feed path EVP.

In the described embodiment, the second, third and forth pair of rollers 20*a*, 20*b* rotate the mailpiece, while the first and fifth pairs 20*a*, 20*b* effect pure linear translation of the mailpiece 14. While the amount of rotation effected by each of the cooperating pairs 20*a*, 20*b* may differ from an upstream to a downstream pair, in the described embodiment, each of the intermediate pairs 20*a*, 20*b* rotates the mailpiece 14 about thirty degrees (30° about the respective virtual axis VA. Further, by examination of the speed profiles SPL, SPU, it will be noted that the profiles diverge or differ when the processor 30 effects controlled rotation of the mailpiece 14 and may converge to the same speed to effect pure linear motion of the mailpiece 14. Moreover, it should also be noted that the speed of both pairs 20*a*, 20*b* remains positive (i.e., does not reverse directions) to continue linear movement of the mailpiece 14 along the feed path EFP while, at the same time, rotating the mailpiece 14.

Finally, it may be desirable to vary the separation distance between the upper and lower rollers 20*a*, 20*b* of each coupled pair. For example, to achieve a controlled rotation of the mailpiece 14, the separation distance SD2, SD3 of the second and third pairs 20*a*, 20*b* of rollers, i.e., from an upstream to a downstream pair, may increase to optimally control the displacement and rotation of the mailpiece 14.

Figure 6:
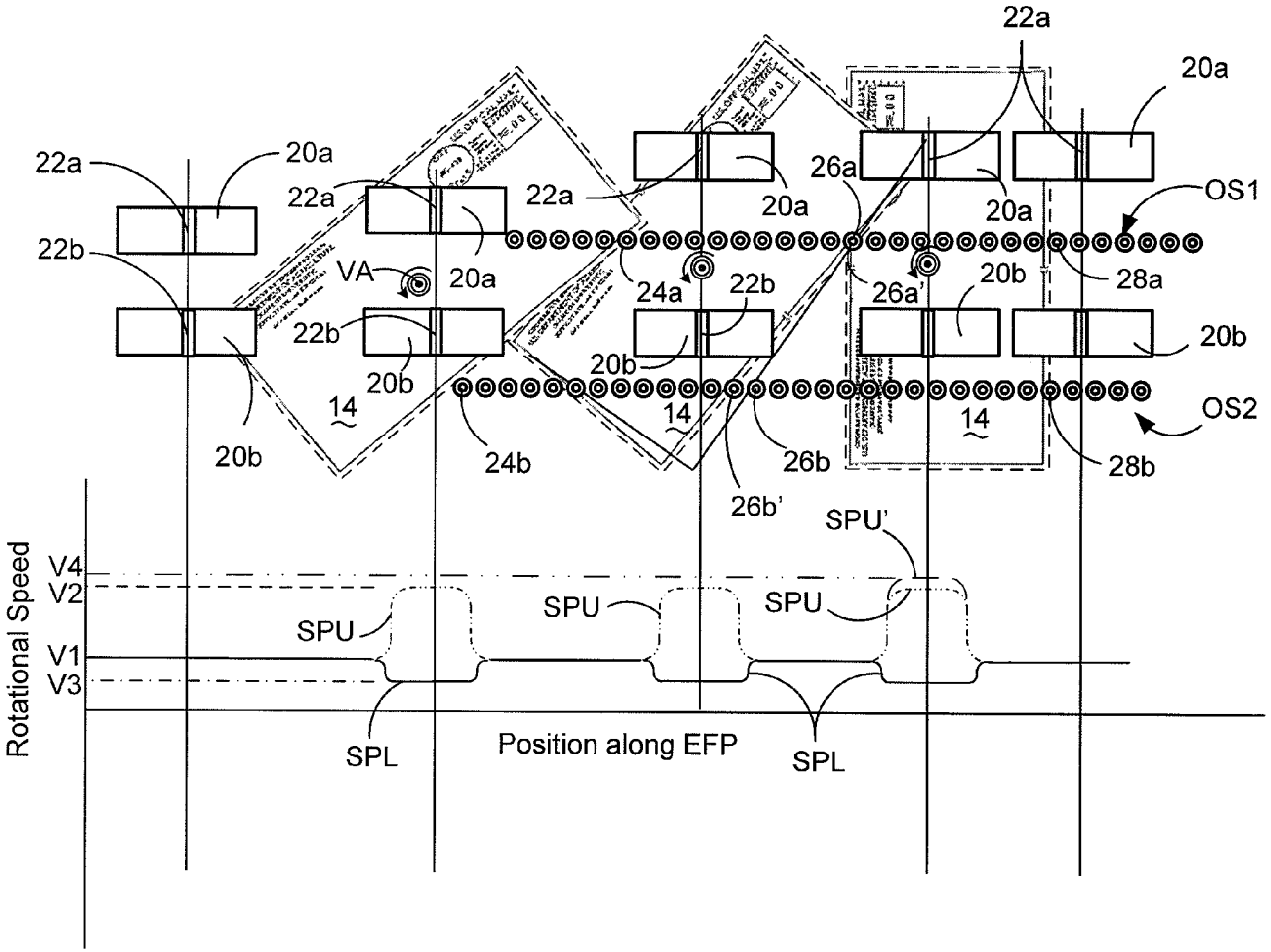
FIG. 6 depicts an alternate embodiment of the invention wherein sensors provide mailpiece position feedback to the processor such that corrective action can be taken, i.e., a modification to the speed profile, when the actual mailpiece position deviates from a scheduled mailpiece position.

In FIG. 6, an alternate embodiment of the invention is shown which includes a plurality of sensors disposed along the feed path EFP and between the coupled pairs 20*a*, 20*b* of rollers. Therein, rows of light-detecting photocells OS1, OS2 sense the position of the mailpiece as it transitions from an on-edge lengthwise orientation to an on-edge widthwise orientation. The array of photocells OS1, OS2 is directed across the plane of the mailpiece 14 to detect the linear and angular position of the mailpiece leading edge 14L. Orientation signals are fed to the processor (not shown in FIG. 6) to determine whether the mailpiece is accurately or appropriately positioned relative to prescribed position data, i.e., a position schedule recorded and stored in processor memory.

If an error exists between the actual position and the scheduled position of the mailpiece 14, the processor may increase or decrease the differential speeds of one or more coupled pairs 20*a*, 20*b* to implement a corrective displacement/rotation. For example, the actual leading edge position of the mailpiece 14, shown in solid lines, may correspond to a first line AP intersecting photocells 26*a*, 26*b*. If, however, the scheduled position corresponds to a second line DP intersecting photocells 26*a*' 26*b*', the processor may change the speed profile SPU' of a downstream pair of rollers 20*a*, 20*b* to increase the speed of the lower rollers 20*b* to a velocity V4. As such, the processor may implement a corrective action to change the mailpiece position or rotation i.e., as the mailpiece traverses from an intermediate upstream position to a subsequent downstream position.

Figure 7:
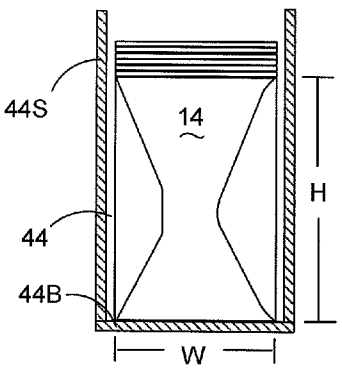
FIG. 7 is a sectional view taken substantially along line 7-7 of FIG. 2 depicting a view through sortation bins/trays of a sortation bin module.

In FIGS. 2 and 7, the displacement system 10, therefore, changes the orientation of the mailpiece 14 from an on-edge lengthwise orientation in the feeder 16 to an on-edge widthwise orientation for use in a bin/tray module 50. Additionally, the mailpiece sorter 40 (FIG. 2) can be adapted to include sortation bins/trays 44 which accept and stack the on-edge widthwise dimension of the mailpieces 14. Specifically, the sortation bins/trays 44 are adapted to support the short edge or width dimension W of the mailpiece 14 while guiding the long edge or length dimension L on each side thereof. That is, the base 44B of the bins/trays 44 support the on-edge width dimension W, while sidewall guides 44S, disposed at substantially right angles to the base 44B, support the length dimension L of each mailpiece 14.

Inasmuch as the widthwise dimension W (FIG. 7) of many mailpiece types can be significantly less than the lengthwise dimension L, the sortation bin module 50 can occupy less space or accommodate more sortation bins/tray 44. By examination and comparison of FIGS. 1 and 2, it will be appreciated that the mailpiece sorter 40 (FIG. 2), which incorporates the displacement system 10 of the present invention, can be combined with a bin module 50 having eight (8) additional sortation bins/trays 44. In FIG. 2, the additional bins/trays 44 are shown in dashed lines and in series with an upstream set of sixteen (16) bins/trays 44. Accordingly, twenty-four (24) sortation bins/trays 44 occupy the same space as the sixteen (16) bins 110 used in the prior art mailpiece sorter 100 (FIG. 1). Alternatively, the sortation bin 50 may occupy fifty percent (50%) less floor space than an equivalent sortation module of a prior art sorter 100.

Although the invention has been described with respect to a preferred embodiment thereof, it will be understood by those skilled in the art that the foregoing and various other changes, omissions and deviations in the form and detail thereof may be made without departing from the scope of this invention.

Sortation Bin Module for Sorting Mailpieces

Figure 8:
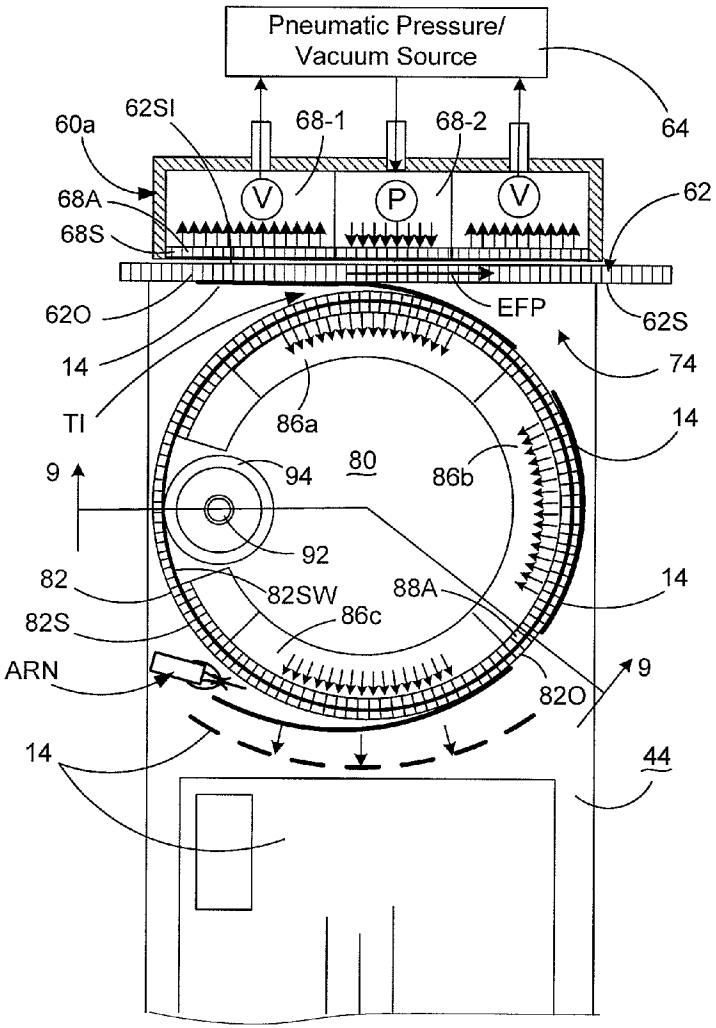
FIG. 8 is a sectioned and partially broken-away top view of pneumatic conveyor and diverter modules for transporting and sorting mailpieces from a central envelope feed path to a sortation bin.

In FIGS. 2 and 8, a sortation bin module 50 includes first and second back-to-back conveyor modules 60*a*, 60*b* operative to feed mailpieces 14 to one (1) of two (2) banks 70*a*, 70*b* of sortation bins 44. The first and second banks 70*a*, 70*b* of sortation bins 44 are each disposed along each side and opposing one of the conveyor modules 60*a*, 60*b*. To send a mailpiece 14 to the correct bank 70*a*, 70*b* of sortation bins 44, the sortation bin module 50 includes a diverter flap 54 for bi-directionally sending mailpieces 14 to either of the conveyor modules 60*a*, 60*b*. The processor 30 controls the diverter flap 54 based upon information obtained from the mailpiece 14 and processed by the sortation algorithm. In addition to the diverter flap 54, each bank of sortation bins 70*a*, 70*b* includes a plurality of diverter modules 80 disposed at the input ends 74 of the individual sortation bins 72. The diverter modules 80 are operative to divert mailpieces 14 from the feed path EFP, i.e., from of either of the back-to-back conveyor modules 60*a*, 60*b*, to the proper sortation bin 44.

For ease of discussion and illustration, the structure and function of the conveyor and diverter modules 60*a*, 60*b*, 80 will be discussed in the order that a mailpiece may travel along a module and within the sortation bin module 50. Furthermore, only one of the back-to-back conveyors 60*a* and a single diverter module 80 (see FIG. 8) will be discussed inasmuch as the conveyor modules 60*a*, 60*b* are essentially mirror images of the other and the diverter module 80 is identical from one sortation bin 44 to another.

A mailpiece 14 is accepted by the sortation bin module 50 from the displacement module 10 discussed above. As such, the mailpiece 14 is in an on-edge widthwise orientation as the diverter flap 54 directs the mailpiece 14 to one of the conveyor modules 60*a*, 60*b*. Each conveyor module 60*a*, 60*b* includes a flexible conveyor belt 62 which defines a conveyor surface 62S, and a pneumatic system or means 64 for developing a pressure differential across the conveyor surface 62S. Each diverter module 80 similarly includes a cylindrical diverter sleeve 82 which defines an arcuate diverter surface 82S and, similar to each of the conveyor modules 60*a*, 60*b*, a pneumatic system or means for developing a pressure differential across the diverter surface 84. In the described embodiment, a common pneumatic system 64 is employed to develop a pressure differential across the diverter surface 82S, i.e., the same pneumatic system 64 is used for both the conveyor and diverter modules 60*a*, 60*b*, 80.

The flexible conveyor belt 62 of each module 60*a* is driven about end rollers 66 similar to any conventional conveyor belt system, however, the conveyor surface 62S thereof is porous and includes a plurality of orifices 62O for allowing the flow of air therethrough. More specifically, at least one pneumatic chamber 68-1 is disposed between the strands of the conveyor belt 62 (only one strand is depicted in FIG. 8) and includes a plurality of apertures 68A which are aligned/in fluid communication with the orifices 62O of the conveyor surface 62S. That is, the apertures 68A of a pneumatic chamber 68-1 are disposed in a sidewall structure 68S thereof which lie adjacent to interior face 62SI of the flexible conveyor belt 62.

As mentioned earlier, the pneumatic chamber 68-1 is in fluid communication with a pneumatic source 64 capable of generating a positive or negative pressure (i.e., a vacuum) in the chamber 68-1 which, in turn, develops a pressure differential across the conveyor surface 62S. While any processor may be used to control the pneumatic source 64, it is preferable that the main system processor 30 be employed to orchestrate the flow of air. Specifically, the processor 30 controls the pneumatic source 64 such that a negative pressure differential is developed to accept and hold mailpieces 14 to the conveyor surface 62S and/or a positive pressure differential is developed to release mailpieces 14 from the conveyor surface 62S.

To improve the fidelity and/or flexibility of the conveyor module, the internal plenum may be segmented into a plurality of chambers 68-1, 68-2 to develop a plurality of linear control regions, i.e., along the length of the conveyor surface 62S. That is, as a mailpiece 14 passes a particular linear control region, the pneumatic source 64 may be controlled to develop a negative pressure to hold the mailpiece 14, or a positive pressure to release the mailpiece 14. Alternatively, the pressure differential may be neutralized to allow another pneumatic conveyor or diverter to remove the mailpiece from the conveyor surface 62S.

The diverter module 80 is generally cylindrical in shape and opposes the conveyor module 60*a* such that the conveyor and diverter surfaces 62S, 82S define a transfer interface TI therebetween. The diverter module 80 is driven about an axis 80A and disposed over an internal system of plenum chambers 86*a*, 86*b*, 86*c* having a substantially complementary shape, i.e., cylindrical. In the described embodiment, the diverter sleeve 82 is driven by a motor 90 which drives a pair of friction rollers 94 via an internal drive shaft 92. More specifically, the rollers 94 frictionally engage an internal wall 82SW of the diverter sleeve 82 to drive the external diverter surface 82S thereof about the internal plenums 86*a*, 86*b*, 86*c*.

The diverter surface 82S includes a plurality of orifices 82O which are in fluid communication with each of the plenum chambers 86*a*, 86*b*, 86*c*. More specifically, the plenum chambers include arcuate sidewalls 86S which define a plurality of apertures 88A which are in fluid communication with the orifices 82O of the diverter surface 82S. Each of the plenum chambers 86*a*, 86*b*, 86*c* are in fluid communication with the pneumatic source 64 such that a positive, negative or neutral pressure differential may be developed across the diverter surface 82S. Similar to the conveyor module 60*a*, the pneumatic source 64 may be controlled such that a variable pressure differential, i.e., positive, negative or neutral, may be developed across various arcuate control regions which correspond to the radial position of each of the plenum chambers 86*a*, 86*b*, 86*c*.

Figure 9:
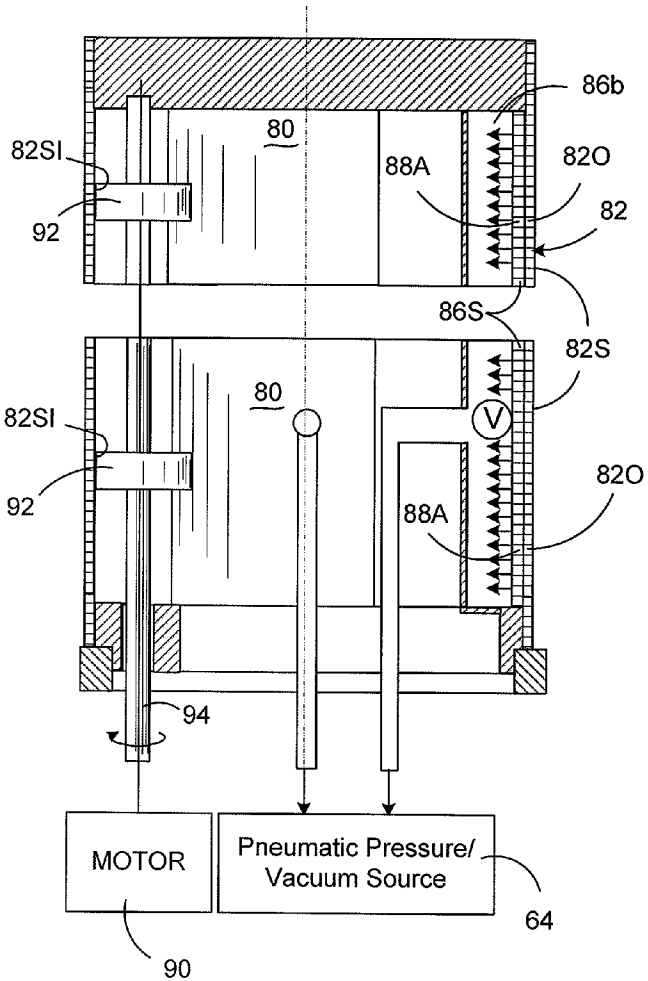
FIG. 9 is a sectional view taken substantially along line 9-9 of FIG. 8 depicting a lengthwise side view through the pneumatic diverter of the sortation bin module.

In FIGS. 8 and 9, a mailpiece 14 is held by a vacuum V developed in chamber 68-1 and conveyed along the feed path EVP by the linear motion of the conveyor surface 62S. As the leading edge of the mailpiece 14 reaches the transfer interface TI, the conveyor surface 62S is exposed to a second chamber 68-2 wherein the vacuum or negative pressure V is either neutralized or pressurized to develop a positive pressure differential. In the illustrated embodiment, a positive pressure P forcibly removes the mailpiece 14 from the conveyor surface 62S.

At the same time, a first plenum chamber 86*a*, or quadrant of the diverter module 80, develops a negative pressure differential to remove and hold the mailpiece to the diverter surface 82S. As the diverter sleeve 82 rotates, the diverter surface 82S and mailpiece 14 traverses a second plenum chamber 86*b* or second quadrant of the diverter module 80. A negative pressure differential is developed in the respective control region such that the mailpiece 14 is held against the diverter surface 82S and is moved away, or transversely, from the conveyor surface 62S. Continued rotation of the diverter sleeve 82 causes the diverter surface 82S and mailpiece 14 to traverse a third plenum chamber 86*c* or third quadrant of the diverter module 80.

When the mailpiece 14 is aligned with the entrance of the sortation bin 44, a neutral or positive pressure differential may be developed in the final control region such that the mailpiece 14 is released from the diverter surface 82. In FIG. 8, the mailpiece 14 is shown in dashed lines to illustrate an intermediate position immediately prior to being stacked in the sortation bin 44. To augment the removal of the mailpiece 14 from the diverter surface 82S, other active pneumatic devices may be employed. For example, an air knife ARN may be employed to supply a sheet of pressurized air tangentially of, and interposing, the diverter surface 82S and the mailpiece 14. The sheet of air assists in the removal of the mailpiece 14 by peeling away an edge of the mailpiece 14 from the diverter surface 82S.

In summary, the conveyor and diverter modules 60*a*, 60*b*, 80 pneumatically transport and sort mailpieces 14 in a sortation bin module 50. Pneumatic control of the conveyor and diverter modules 60*a*, 60*b*, 80, along with the use of independently controlled pneumatic plenums/chambers, improves the reliability of the sortation apparatus 40 while decreasing the opportunity for mailpiece damage/jamming. Further, the conveyor and diverter modules 60*a*, 60*b*, 80 are ideally suited to transport mailpieces 14 in an on-edge widthwise orientation, i.e., along the width dimension thereof. Since the width dimension W (see FIG. 7) of many mailpieces can be significantly less than the length dimension L, the sortation bin module 50 may be adapted to occupy less space and/or accommodate the introduction of additional sortation bins 44.

Compliant Diverter for Mailpiece Transport

In view of today's ever widening variety of packages delivered through the mail (e.g., products associated with on-line sales and internet auctions), it will be appreciated that the conveyor and diverter modules 60*a*, 60*b*, 80, must handle/process a variety of mailpiece sizes, shapes, and other physical properties. Whereas some mailpieces, having conventional printed content material, are flexible along axes which lie in the plane of the mailpiece 14, others containing commercial products such as media or video discs, i.e., CDs and DVDs, are substantially rigid in the plane of the envelope. That is, the plastic containers used to package such products produce a substantially stiff, planar mailpiece.

As such, greater difficulties are experienced to produce the requisite pressure differential to secure the mailpiece 14 against the diverter surface 82S, especially when centrifugal forces developed as the diverter sleeve 82 rotates oppose the forces induced by vacuum. That is, the rigidity of the mailpiece 14 causes the mailpiece 14 to contact the diverter sleeve 82 at a point of tangency rather than along an arcuate surface, e.g., as a flexible mailpiece wraps around an arcuate portion of the sleeve 82. As a result, only a small number of orifices 82O, i.e., along a vertical line, may be available to produce the requisite pressure differential. If the pressure differential produced is less than the weight induced moment loads, i.e., the loads tending to pull the mailpiece 14 away from the diverter surface 82S, the mailpiece 14 will not be retained or secured by the pneumatic diverter module 80.

Figure 11:
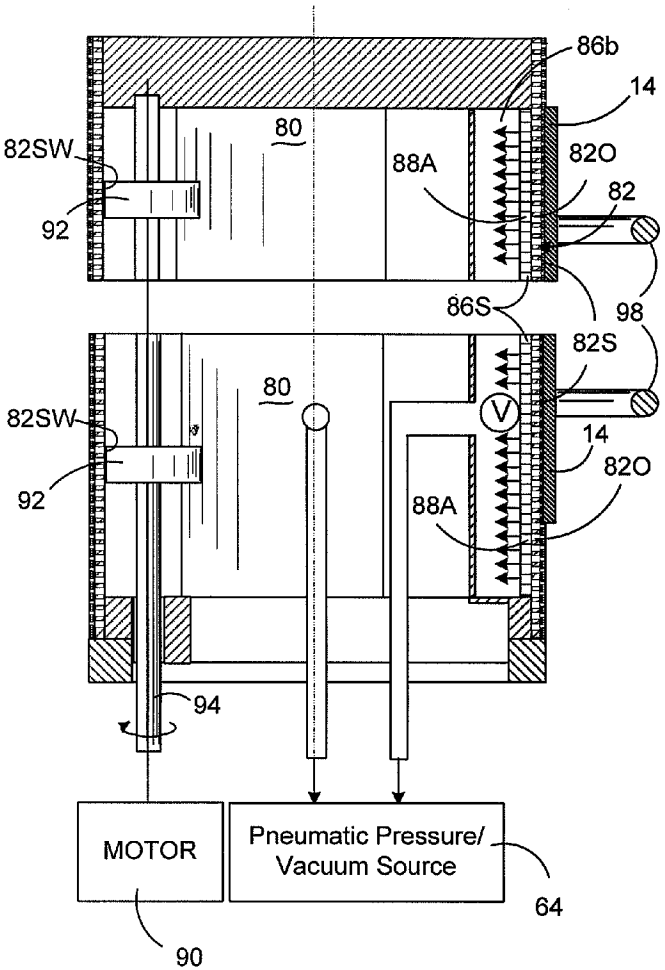
FIG. 11 is a sectional view taken substantially along line 11-11 of FIG. 10 depicting a lengthwise side view through the compliant diverter.
Figure 10:
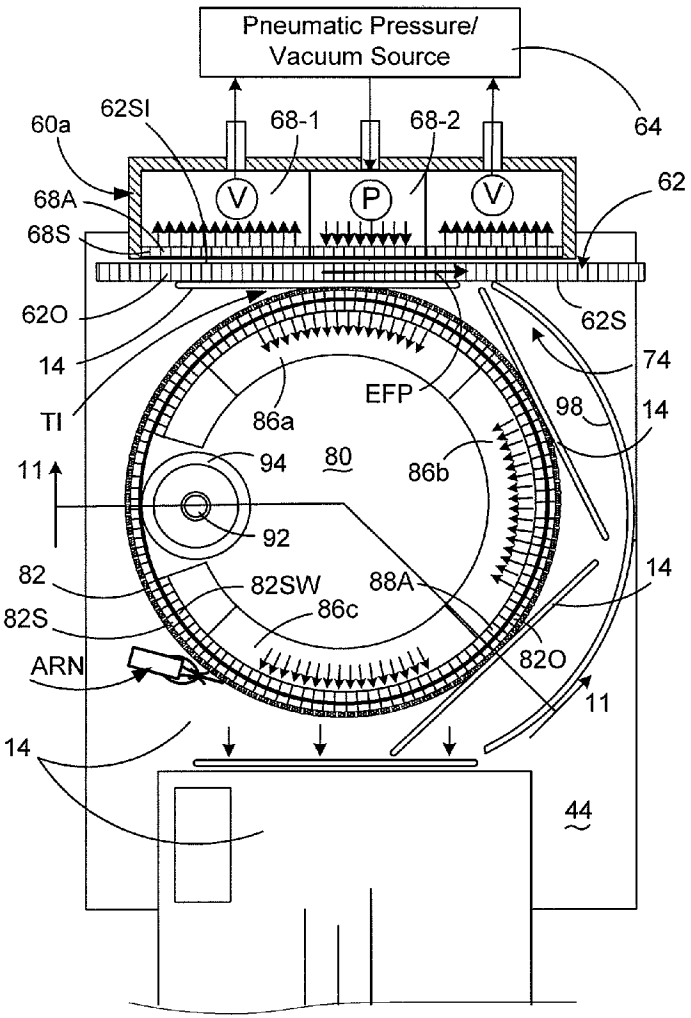
FIG. 10 is a sectioned and partially broken-away top view of a compliant conveyance system, e.g., a compliant diverter, for transporting and sorting relatively stiff/rigid, planar mailpieces from a central envelope feed path to a sortation bin along an arcuate feed path.

The present invention addresses these concerns by adapting the diverter sleeve 82 to conform to the shape of the mailpiece 14. More specifically, in FIGS. 10, 11 and 12, the diverter sleeve 82 comprises a rigid inner portion 82SI and a resilient outer portion 82SO. Similar to the embodiment discussed supra, the rigid inner portion 82SI rotates about, and is in fluid communication with, the various stationary pneumatic plenum chambers 86*a*, 86*b*, 86*c*. Consequently, the inner portion 82SI is essentially the same as previously described, but for a small change in radial thickness. That is, to accommodate the dimensional changes which may result from the outer portion 82SO.

Figure 12:
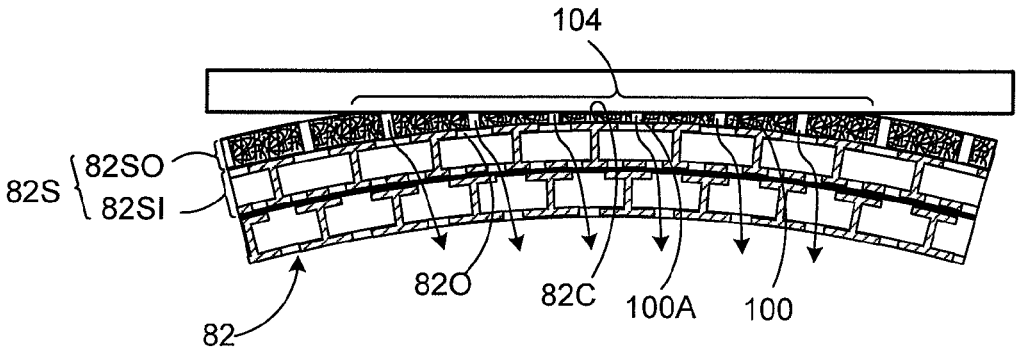
FIG. 12 is an enlarged broken away view through a section of the complaint diverter having an exterior layer of resilient foam which is perforated and compliant to allow a pressure differential to develop while conforming to the external shape of the rigid mailpiece.
Figure 13:
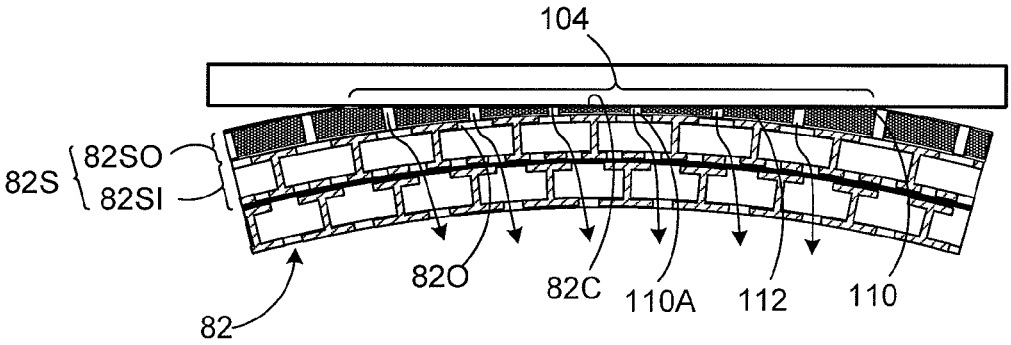
FIG. 13 is an enlarged broken away view through a section of the complaint diverter, similar to the view shown in FIG. 12, including an exterior layer of poly-tetra-flora-ethylene (PTFE) disposed over a resilient elastomer.
Figure 14:
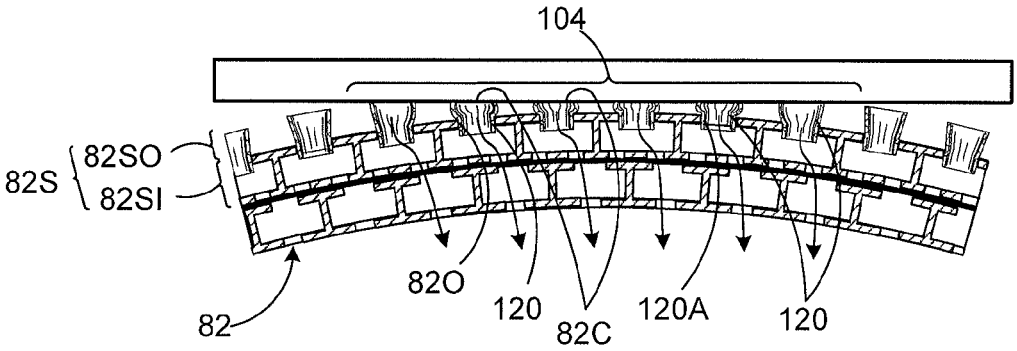
FIG. 14 is an enlarged broken away view through a section of the complaint diverter, similar to the view shown in FIG. 12, including an array of radially oriented compliant tubes forming a bed of vacuum feet which conform to the external surface of the mailpiece.

In FIGS. 12, 13 and 14, the outer portion 82SO is disposed over the inner portion 82SI and forms a compliant interface surface 82C for conveying mailpieces 14. In one embodiment shown in FIG. 12, the outer portion 82SO comprises an exterior layer of resilient foam 100 having a plurality of perforations or apertures 100A which are in fluid communication with the orifices 82O of the rigid inner sleeve portion 82SI. The resilient foam 100 is sufficiently soft to compress a full forty (40) to eighty (80) percent of the original thickness i.e., $T_{L=FULL}/T_{L=0}$, under the vacuum load produced by the vacuum source 64. As a result, the resilient foam 100 is sufficiently compliant to conform to the external shape of the rigid mailpiece, i.e., the surface 104 of the outer portion 82SO in contact with the rigid mailpiece 14 conforms to the planar external surface of the mailpiece 14.

In another embodiment of the invention shown in FIG. 13, the resilient outer portion 82SO includes a flexible outer layer 110 of poly-tetra-flora-ethylene (PTFE) disposed over a resilient support layer 112. The PTFE outer layer is sufficiently thin to deform under load and, in the described embodiment, has a thickness dimension T within a range of between 0.020 inches to about 0.050 inches. The resilient support layer 112 may be comprised of an elastomer material to bias the PTFE layer outwardly, thereby producing a soft, compliant spring. Preferably the elastomer material is a polychloroprene rubber made from a family of synthetic rubbers that are produced by polymerization of chloroprene and is characterized by a low durometer of between about 30 to 40. Similar to the previous embodiment, apertures 110A are formed in, and extend through, the outer layer 110A of poly-tetra-flora-ethylene (PTFE) and underlying resilient support layer 112.

In another embodiment of the invention shown in FIG. 14, the resilient outer portion 82SO of the diverter sleeve 82 includes an array of closely-spaced, highly flexible, rubber tubes 120 which project radially from the orifices 82O of the rigid inner portion 82SI. In the described embodiment the rubber tubes 120 are fabricated from short lengths of surgical rubber tubing defining a flexible conduit 120A for pneumatic fluid flow. Preferably, the rubber tubes 120 are fabricated from a Latex or a "gum" rubber material. In the described embodiment, the rubber tubes 120 are between about one-quarter (¼) to three-quarter (¾) inches in length and may vary in diameter from one-eighth (⅛th) to one-half (½) inches in diameter. The array of tubes 120, therefore, define a plurality of short, densely-packed suction cups which are sufficiently flexible to conform to the surface of the mailpiece 14.

Operationally, and referring once again to FIGS. 10 and 11, the diverter 80 of the compliant conveyance system may be used/controlled in the same manner as was previously described when discussing the conveyor and diverter modules 60*a*, 60*b*, 80 of the sortation bin module 50. That is, mailpieces 14 may be transferred from one of the conveyor modules 60*a*, 60*b* to a diverter 80 by alternately producing a positive pressure differential to release a mailpiece 14 (e.g., from a conveyor module 60*a* or 60*b*) and a negative pressure differential to receive and secure a mailpiece 14 (e.g., to the diverter module 80). Similarly, the release a mailpiece 14 from the diverter 80 may be achieved by producing a neutral or positive pressure differential within one of the plenum chambers 86*a*, 86*b*, 86*b*.

Inasmuch as the diverter 80 of the compliant conveyance system may handle substantially rigid, planar mailpieces, the compliant interface surface 82C conforms to at least a portion of the interface surface of the mailpiece 14. As such, the compliant interface surface 82C augments the pressure differential developed across each respective mailpiece 14 (i.e., by increasing the number of vacuum orifices acting on the surface of the mailpiece.

To ensure that a mailpiece 14 remains in contact with the compliant interface surface 82C, the conveyance system includes a guide rail 98 disposed about, and spaced apart from, at least a portion of the compliant interface surface 82C. More specifically, the guide rail 98 is operative to retain a portion of the mailpiece 14 as the mailpiece is diverted along the feed path, i.e., from the conveyor belt 62 to the sortation bin 44.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A conveyance system for conveying and diverting sheet material along a feed path, comprising:

a diverter having at least one sidewall structure defining an internal chamber in fluid communication with the pressure source and adapted for rotation about an axis, the sidewall structure having a compliant interface surface for conveying sheet material along the feed path and a plurality of orifices effecting fluid communication between the compliant interface surface and the internal chamber, a means for developing a pressure differential across the sheet material through the orifices to urge an interface surface of the sheet material against the compliant interface surface of the diverter, the compliant interface surface conforming to at least a portion of the sheet material interface surface to augment the pressure differential developed by the pressure differential means, the compliant interface surface is defined by an array of flexible rubber tubes, each tube projecting radially from an orifice of the diverter sidewall and in fluid communication with the internal chamber of the diverter;

a means for driving the diverter about the rotational axis from a first to a second rotational position; and a controller operative to control the pressure differential developed by the pressure differential means such that, in the first rotation position, the sheet material is secured against the compliant interface surface and, in the second rotational position, the sheet material is released from the compliant interface surface.

2. The conveyance system according to claim 1 wherein the pressure differential means is controlled such that, in the first rotation position, a negative pressure differential is produced to secure the sheet material against the compliant interface surface and, in the second rotational position, a neutral pressure differential is produced to release the sheet material from the compliant interface surface.

3. The conveyance system according to claim 1 wherein the pressure differential means is controlled such that, in the first rotation position, a negative pressure differential is produced to secure the sheet material against the compliant interface surface and, in the second rotational position, a positive pressure differential is produced to release the sheet material from the compliant interface surface.

4. The conveyance system according to claim 1 further comprising a guide rail disposed about, and spaced apart from, at least a portion of the compliant interface surface, the guide rail operative to retain a portion of the sheet material as the mailpiece is diverted along the feed path.

5. The conveyance system according to claim 1 wherein the sheet material is a substantially planar mailpiece.

6. A method for conveying and diverting sheet material along a feed path, comprising the steps of:

conveying the sheet material along a first feed path;

diverting the sheet material along a second feed path by a compliant diverter, the compliant diverter having at least one sidewall structure defining an internal chamber in fluid communication with the pressure source and adapted for rotation about an axis, the sidewall structure having a compliant interface surface for conveying the sheet material along the second feed path and a plurality of orifices effecting fluid communication between the compliant interface surface and the internal chamber, the compliant interface surface defined by an array of flexible rubber tubes, each tube projecting radially from an orifice of the diverter sidewall and in fluid communication with the internal chamber of the compliant diverter, developing a pressure differential across the sheet material through the orifices to urge an interface surface of the sheet material against the compliant interface surface of the diverter and cause the compliant interface surface to conform to at least a portion of the sheet material interface surface driving the diverter about the rotational axis from a first to a second rotational position; and controlling the pressure differential developed such that, in the first rotation position, the sheet material is secured against the compliant interface surface and, in the second rotational position, the sheet material is released from the compliant interface surface.

7. The method according to claim 6 wherein the step of controlling the pressure differential includes the steps of controlling the pressure differential such that, in the first rotation position, a negative pressure differential is produced to secure the sheet material against the compliant interface surface and, in the second rotational position, a neutral pressure differential is produced to release the sheet material from the compliant interface surface.

8. The method according to claim 6 wherein the step of controlling the pressure differential includes the steps of controlling the pressure differential such that, in the first rotation position, a negative pressure differential is produced to secure the sheet material against the compliant interface surface and, in the second rotational position, a positive pressure differential is produced to release the sheet material from the compliant interface surface.

9. The method according to claim 6 further comprising the step of guiding the sheet material as the sheet material travels along the second feed path.

* * * * *